US006572106B2

(12) United States Patent
Alexoff

(10) Patent No.: US 6,572,106 B2
(45) Date of Patent: Jun. 3, 2003

(54) MULTI PRICE POINT ON-LINE GAME AND METHOD OF PLAYING

(76) Inventor: Carl Alexoff, P.O. Box 368, Callao, VA (US) 22435

( * ) Notice: Subject to any disclaimer, the term of this patent is extended or adjusted under 35 U.S.C. 154(b) by 0 days.

(21) Appl. No.: 09/872,858

(22) Filed: Jun. 4, 2001

(65) Prior Publication Data

US 2002/0180151 A1 Dec. 5, 2002

(51) Int. Cl.[7] ..... A63B 71/00

(52) U.S. Cl. ..... 273/138.1; 273/139; 273/148 R; 283/901; 283/903

(58) Field of Search ..... 273/292, 269, 273/139, 138.1, 148 R; 283/901, 903

(56) References Cited

U.S. PATENT DOCUMENTS 1,028,724 A * 6/1912 Hirsch ..... 273/139
4,688,797 A * 8/1987 Sebestyen ..... 273/138.1
4,842,278 A * 6/1989 Markowicz ..... 463/18
4,871,172 A * 10/1989 Hwang ..... 273/138.1
4,953,895 A * 9/1990 Goussios ..... 273/139
5,116,049 A * 5/1992 Sludikoff et al. ..... 273/139
5,158,293 A * 10/1992 Mullins ..... 273/139
5,232,221 A * 8/1993 Sludikoff et al. ..... 273/139
5,249,801 A * 10/1993 Jarvis ..... 273/139
5,273,281 A * 12/1993 Lovell ..... 273/138.1
5,569,082 A * 10/1996 Kaye ..... 273/139
5,682,819 A * 11/1997 Beaty ..... 101/483
5,768,382 A * 6/1998 Schneier et al. ..... 380/251
5,970,143 A * 10/1999 Schneier et al. ..... 380/251
5,979,894 A * 11/1999 Alexoff ..... 273/139

* cited by examiner

*Primary Examiner*—Benjamin H. Layno
*Assistant Examiner*—Dolores R. Collins
(74) *Attorney, Agent, or Firm*—Merek, Blackmon & Voorhees, LLC

(57) ABSTRACT

A lotto type online game for use in state sponsored lottery applications, commercial game applications, newspaper circulation builder promotional games, and others. The method of playing allows the player a choice in selecting, at the point of purchase, the price point level to be wagered and the degree of participation desired. The method of playing lottery game includes the step of selecting a first set of numbers from a predetermined group of numbers identified by a lottery sponsor. Winning of a prize is determined by matching a plurality of the numbers of said first set of selected numbers with at least some from a first set of drawn numbers and matching a plurality of the numbers of said first set of selected numbers with at least some from a second set of drawn numbers. The first and second sets of drawn numbers are determined by the lottery sponsor. The game can incorporate the existing equipment of the lottery sponsor for selecting numbers, printing tickets and drawing numbers. The ticket is printed in a format that facilitates multiple plays and prizes and includes play dates and may also include security features thereon.

9 Claims, 7 Drawing Sheets

MULTI PRICE POINT ON-LINE GAME AND METHOD OF PLAYING

RELATED APPLICATIONS

This application is related to and claims priority from U.S. patent application Ser. No. 09/435,917 filed Nov. 8, 1999 and U.S. patent application Ser. No. 09/033,515 filed on Mar. 2, 1998.

FIELD OF THE INVENTION

This invention is directed to a lottery game in which numbers are selected from a group of numbers provided by a lottery sponsor and the selected numbers are matched against numbers drawn from multiple drawings.

BACKGROUND OF THE INVENTION

Lottery games are currently in use in many states and countries and are administered by a lottery sponsor which is affiliated with those entities. Typically, the lottery games include smaller payoff games such as PICK 3 and PICK 4 as well as large jackpot games commonly called LOTTO and POWERBALL. Current jackpot games include matching six or seven numbers selected from a set of 40 or 50 or more against numbers drawn in a weekly or biweekly drawing, while the PICK 3 and PICK 4 games involve a selection of 3 and 4 numbers respectively from a group of usually 10 and matching those numbers against daily drawings held by the lottery sponsor.

In an effort to add to the excitement of jackpot games, a daily version of the lotto game was developed as described in U.S. Pat. Nos. 5,232,221 and 5,116,049. The game described in these patents includes multiple ways to win by matching numbers on the ticket both vertically and horizontally from a daily single digit drawing and a single play is over a seven day time span. In these patents, seven games are in process each day, with a single winning number drawn daily for each of the seven games. Since one number is drawn each day, it takes from seven days (single play) to thirteen days (seven plays) to draw the winning numbers. The numbered balls in the drawing equipment are not reloaded in their respective drawing machines until after the seventh ball has been drawn. This process and procedure requires special drawing equipment and requires players to select seven different numbers. This is cumbersome and costly to the lottery sponsor, and may be confusing to the players, in view of some lotteries currently drawing 42 numbers involving up to six lottery products.

In the game and method of play described herein, all seven winning numbers are drawn by the lottery sponsor each day, and winning tickets are determined on a daily basis. Also, the restriction for the player to select different numbers is eliminated; no specialized drawing equipment is required; and operation is simplified.

In view of the foregoing, it can be seen that there is a need for a new lotto type game which can provide the excitement of lottomania on a daily basis and yet employ the same basic infrastructure of the PICK 3 and PICK 4 games, without adding complexity, cost and/or confusion with current games, drawings and procedures.

OBJECTS AND SUMMARY OF THE INVENTION

It is an object of the invention to provide a game having multiple prize structures with different odds depending on the numbers matched.

It is another object of the invention to integrate the existing winning numbers drawing procedure and equipment into a single game having a variable prize structure.

Yet another object of the invention is to provide a game having a daily drawing with the possibility of a jackpot prize every day as well as lower monetary value prizes with improved odds of winning.

Still another object of the invention is to provide a game based on multiple drawings of a plurality of numbers.

Yet another object of the invention is to provide a game wherein the jackpot winner is determined by matching all of the numbers selected by the player with all of the numbers drawn by the lottery sponsor in multiple drawings of a plurality of numbers.

Still another object of the invention is to provide a game having a ticket with numbers arranged thereon so that the matching of numbers drawn from the plurality of drawings can be accomplished either vertically or horizontally.

Another object of this invention is to provide a multi price point lotto type game which offers players better odds, more ways of winning, more prizes, greater involvement with extended interest, and permits play for a single day, or for a series of consecutive daily plays up to seven on a single ticket.

Yet another object of the invention is to provide a game that progressively adds value as the amount wagered increases, by offering higher price point players better odds, more ways of winning, more prizes, multiple jackpots and more plays.

Still another object of the invention is to provide a game which plays on the lottery sponsor's existing online equipment, and with proprietary or open architecture software systems, whether mainframe or PC based, thereby simplifying implementation and operation.

In summary, this invention is directed to a lotto type online game for use in state sponsored lottery applications, commercial game applications, newspaper circulation builder promotional games, and others. The method of playing allows the player a choice in selecting, at the point of purchase, the price point level to be wagered and the degree of participation desired. The method of playing the lottery game includes the step of selecting a first set of numbers from a predetermined group of numbers identified by a lottery sponsor. Winning of a prize is determined by matching a plurality of the numbers of said first set of selected numbers with at least some from a first set of drawn numbers and matching a plurality of the numbers of said first set of selected numbers with at least some from a second set of drawn numbers. The first and second sets of drawn numbers are determined by the lottery sponsor. The game can incorporate the existing equipment of the lottery sponsor for selecting numbers, printing tickets and drawing numbers. The ticket is printed in a format that facilitates multiple plays and prizes and includes play dates and may also include security features thereon.

DETAILED DESCRIPTION OF THE INVENTION

The invention is directed to a lottery game in which the players' wagers are placed in a common pool and divided among them and the lottery sponsor in accordance with their own selections and the rules of the game. In this game the player can vary the wager and opportunities to win by playing from one to seven consecutive days. This game can incorporate the existing equipment used by the lottery sponsor in administering PICK 3 and PICK 4 lottery games and therefore much of the expense of implementing a new game can be avoided.

Figure 1:
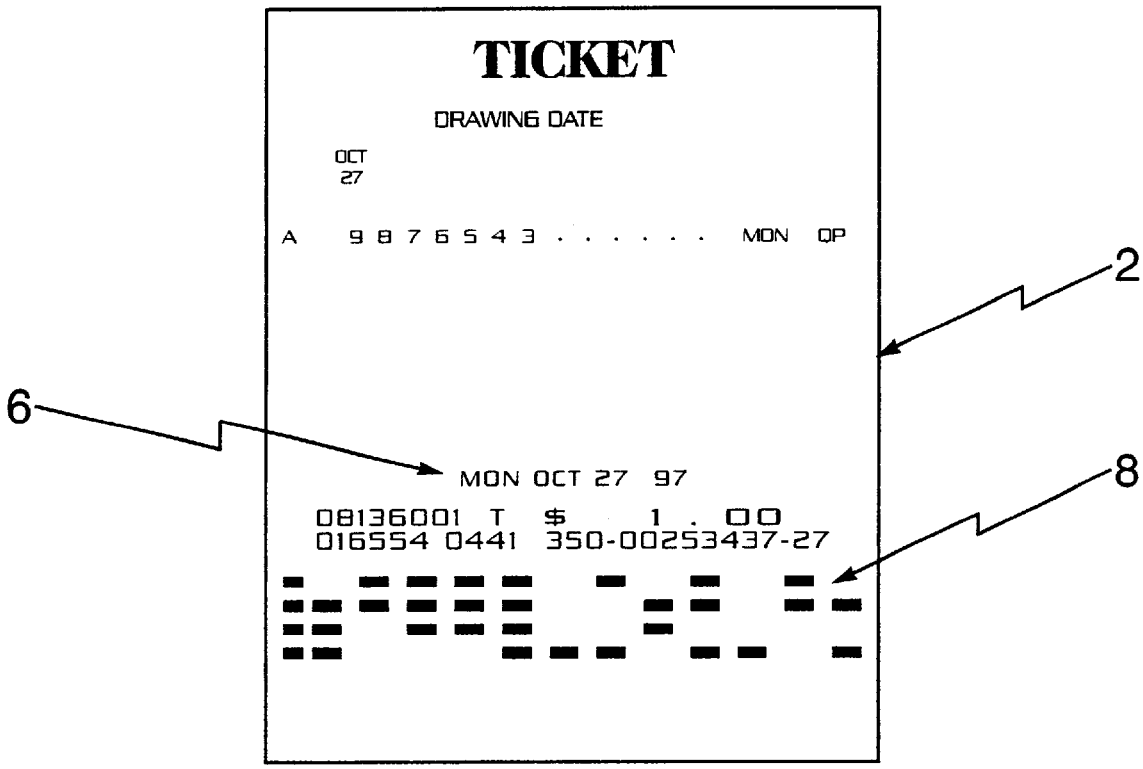
FIG. 1 shows a sample ticket for a one game drawing.

The invention will be further described with reference to the drawing figures. FIG. 1 shows a sample ticket 2 having a single line play A beginning on a designated day 6 (Monday in this instance). Codes 8 prevent counterfeiting of ticket 2 and provide for machine reading and validation of tickets. Preferably, winning of prizes using the ticket 2 in FIG. 1 is accomplished by matching, in the order drawn by the lottery sponsor, either all seven numbers, or by matching six, five, four or three numbers from the Monday drawing. The numbers must be matched in the order drawn. Winning criteria is not limited to matching three numbers drawn, but can be extended to two numbers or even on number at the discretion of the lottery sponsor.

Figure 2:
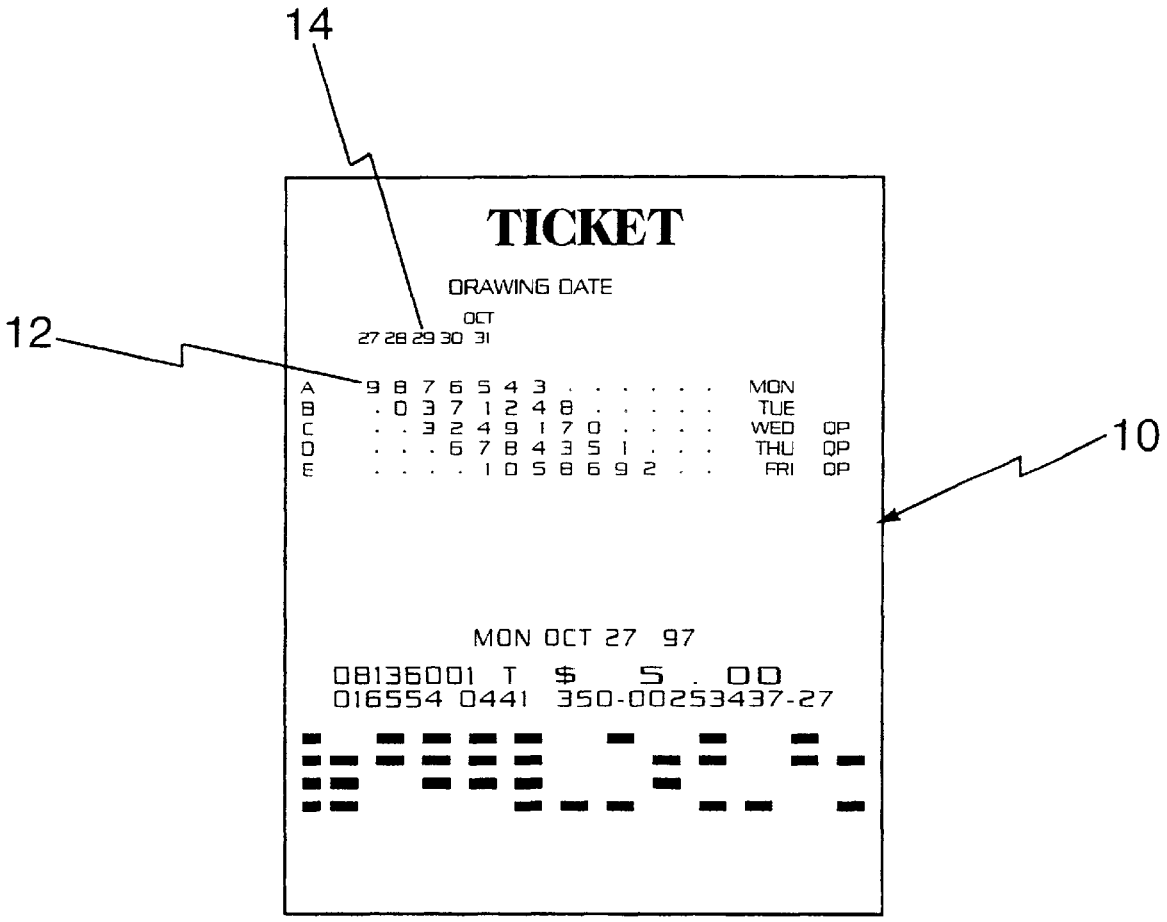
FIG. 2 shows a sample ticket for a five consecutive game drawing.

FIG. 2 shows a five day sample ticket 10 beginning in this instance on Monday and ending on Friday. Seven numbers are selected for each day and are printed on the ticket 10. Each following day's set of seven numbers is offset by one number as shown in FIG. 2. Matching all seven numbers in the top row 12 will produce a winning ticket. Matching three, four, five or six numbers in the order drawn will also produce a prize. The added dimension of vertical matching brings the possibility of additional prizes and player involvement to the game. Vertical matching can begin on the third day of the game with numbers in the third column 14 (733 in this instance). Preferably, vertical matching ends on the third day of a three day ticket, the fourth day of a four day ticket, the fifth day of a five day ticket, the sixth day of a six day ticket, and the seventh day of a seven day ticket.

Figure 3:
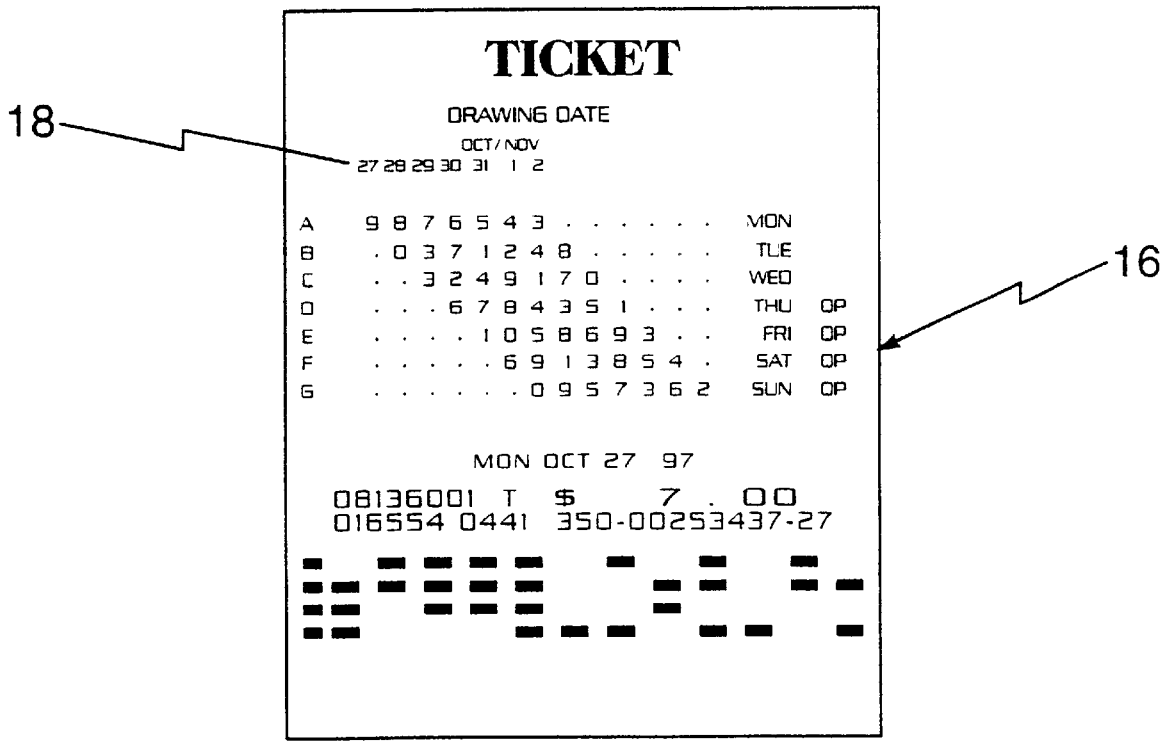
FIG. 3 shows a sample ticket for a seven consecutive game drawing.

A seven day ticket 16 is shown in FIG. 3. As can be seen from the dateline 18, the game starts on Monday, October 27 and lasts for seven days until Sunday, November 2. Each following day's set of seven numbers is offset by one number as shown. On the first day, matching can occur in the horizontal line A by matching the numbers in order in groups of three, four, five, six or seven. For example, matching three numbers across could result by matching either 987, 876, 765, 654, or 543. Matching four numbers across could result by matching either 9876, 8765, 7654, or 6543. Matching five numbers across could result by matching either 98765, 87654, or 76543. Matching six numbers across could occur by matching 987654 or 876543. Horizontal matching would occur in like manner for each following day.

After the third day's drawing, the player can begin to match numbers vertically. On October 29, the player can match the three numbers in the column 733. On October 30, the player could win a prize by matching three numbers vertically, for example, 672 or 726 or all four numbers 6726. On the following day October 31, sets of three, four or five numbers can be matched. The sets of three would include 514, 147, and 471. The sets of four would include 5147 and 1471. The set of five numbers would include 51471. On the following day November 1, sets of three, four, five and six can be matched. On November 2, sets of three, four, five, six and seven can be matched vertically.

In an alternative ticket format, the offset between multiple plays (Play A, B, C, etc.) may be eliminated, and the selected play numbers are left justified so as to form a seven by seven matrix, on a seven play ticket. This is the case when a player chooses to play multiple plays for the same day's drawing.

The matrix format allows for even more ways of winning by permitting play on two diagonals, as well as on each of seven play lines and columns. In all, there would be 16×15 or 240 ways of winning, of which sixteen are for the highest prize.

This format would appeal to players who want "instant gratification" in that all possible ways of winning on a seven play ticket are known in one day, instead of over a seven day period. The player's chances of winning are increased, but play participation is reduced to a single day.

Prizes are awarded for matching, in the order drawn, seven across, six across, five across, four across and three across for a total of fifteen ways to win in the horizontal direction. Prizes may also be awarded for matching, in the order drawn, seven down, six down, five down, four down and three down.

Figure 4:
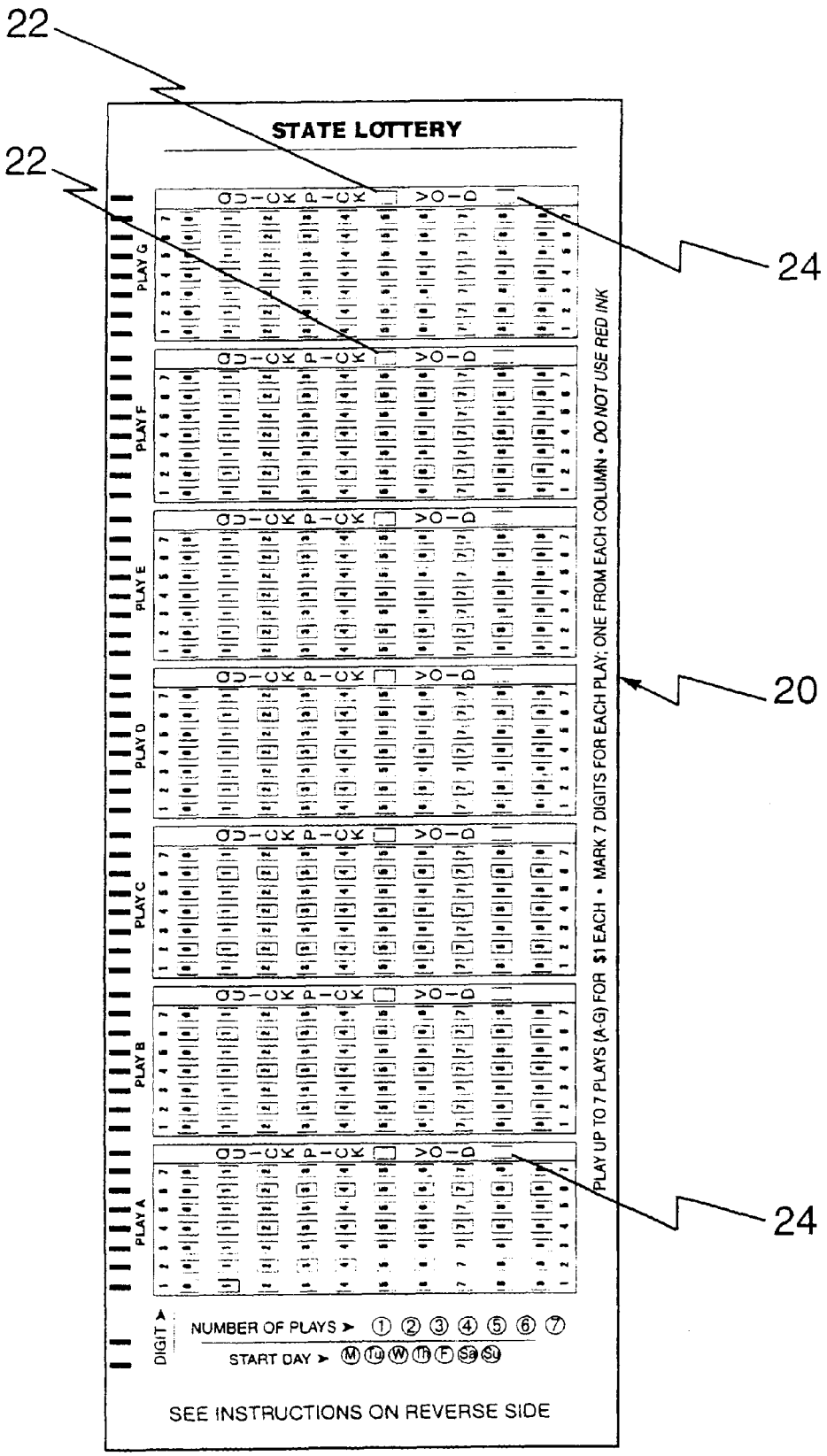
FIG. 4 shows a sample playslip.
Figure 5:
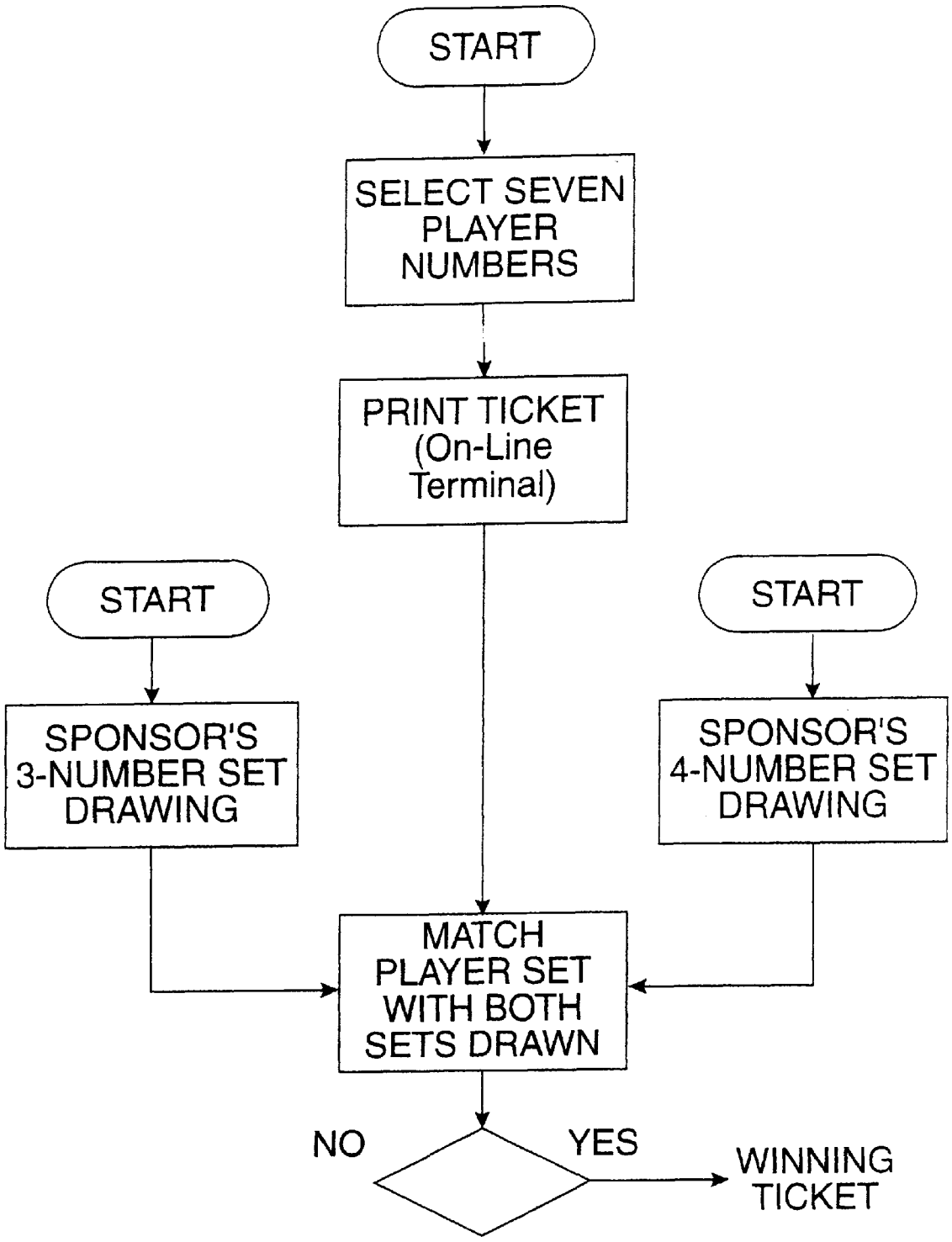
FIG. 5 shows a flow chart depicting game steps.
Figure 6:
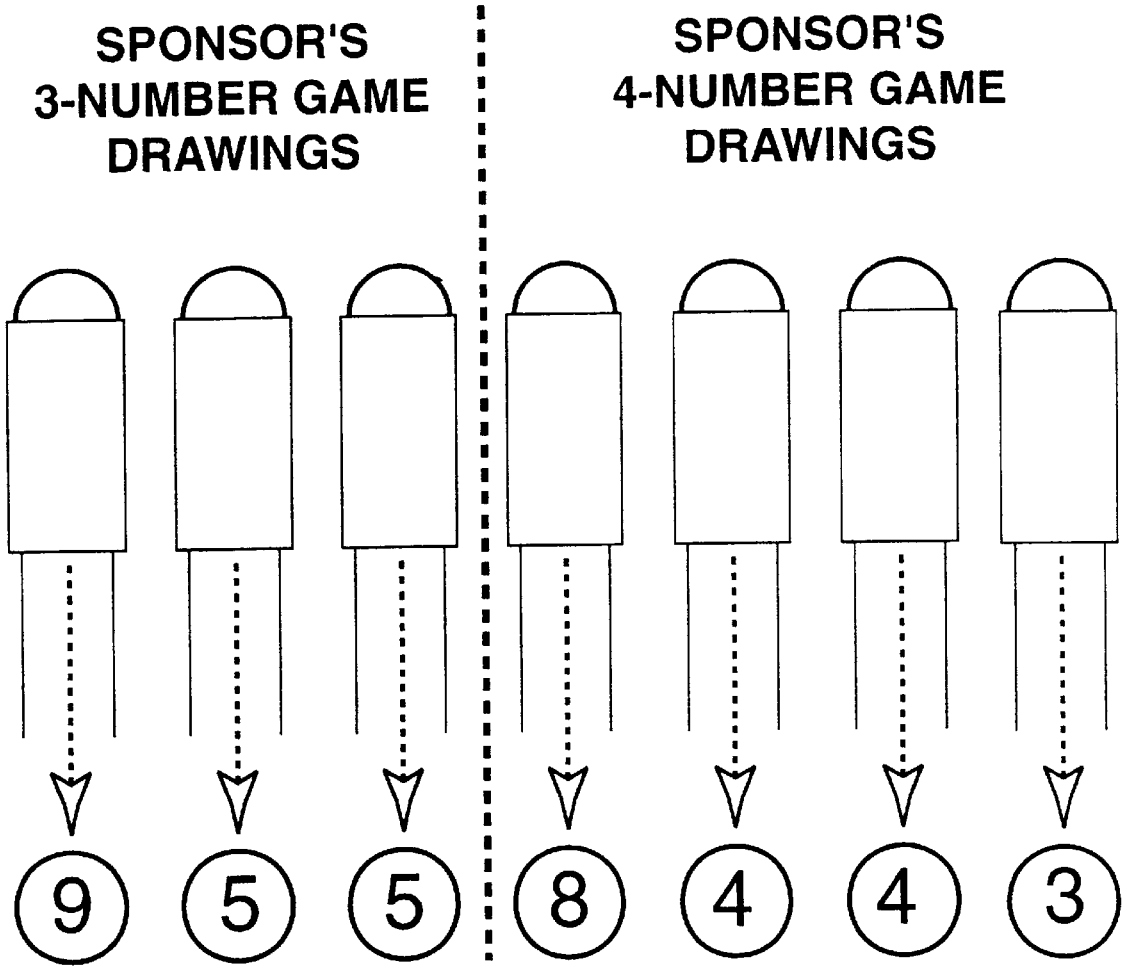
FIG. 6 shows schematically a plurality of random number generators.
Figure 7:
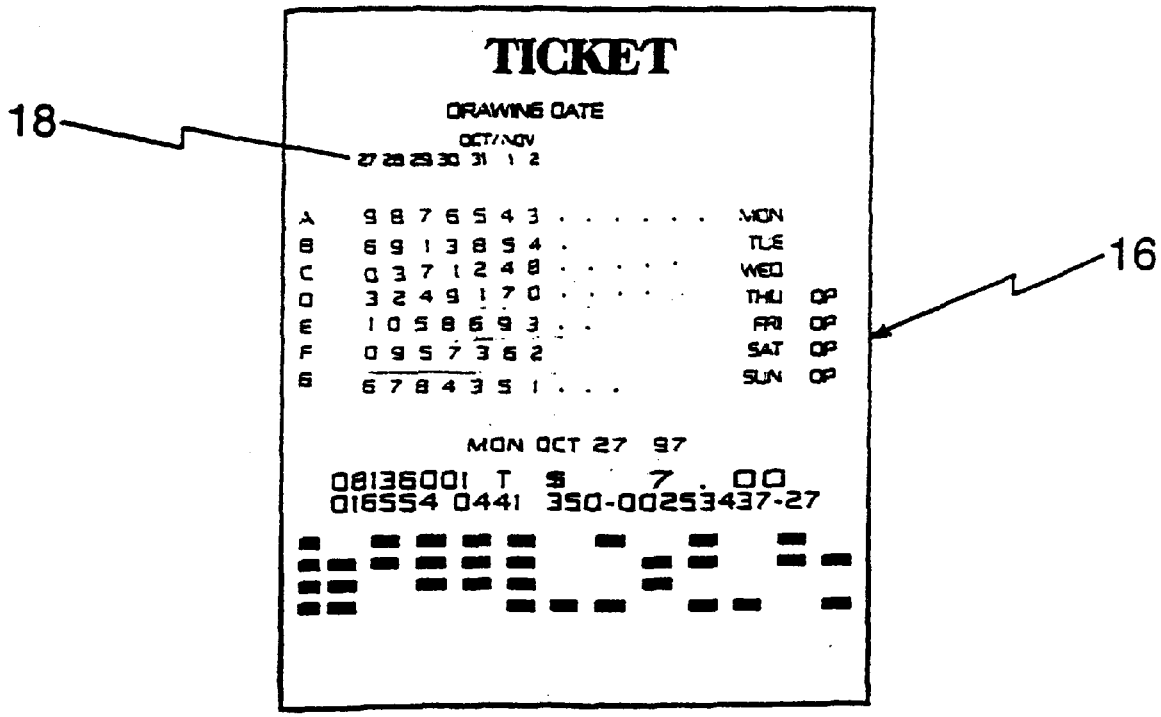
FIG. 7 show an alternative embodiment of a game ticket.

A machine readable playslip 20 is shown in FIG. 4. Playslip 20 is used for selecting numbers to create the tickets shown in FIGS. 1–3. The playslip 20 is then read by a mark/sense reader in the online terminal which records the selected numbers and generates the ticket at the retailer's online terminal at the point of sale. The playslip 20 is designed for use with existing retailer online terminals and the current PICK 3 and PICK 4 drawing equipment which contains ten numbered balls in each machine. Therefore, playslip 20 allows the player to choose for each day of play seven numbers, each number being selected from seven groups of zero to nine. Looking at playslip 20, play areas A through G are shown. Play areas A through G designate consecutive days of play. Play area A contains seven columns of numbers from 0–9. To select a number, the player simply blackens the corresponding square. In play area A, the squares designating numbers 9876543 have been blackened, however any number in each column could be selected and numbers may be duplicated. The player may also elect a "quick pick" play which is a machine generated random number by marking any of the boxes 22 adjacent play areas A–G. If the player makes an error in the selection process, a play area may be voided by marking any of the void boxes 24 in play areas A–G. Preferably, a uniform charge will be assessed for each play area selected, i.e. $1.00 per area, but the charge could change in accordance with the parameters selected by the lottery sponsor.

The game is capable of being used in conjunction with existing equipment currently in use by various lottery sponsors in their PICK 3 and PICK 4 games. This equipment includes for example, proprietary or open architecture software systems, whether mainframe or PC based as well as the random number generating equipment. Since the PICK 3 and PICK 4 in combination have a total of seven numbers, the drawing equipment for these games provides the set of seven winning numbers. The precise manner in which the prize pool is allocated can be tailored to meet the objectives of the lottery sponsor. This allocation is related to the odds of the game and would vary with the prize category selected and the number of balls in the game.

While this invention has been described as having a preferred design, it is understood that the invention is capable of further modifications, uses and/or adaptations following in general the principle of the invention and including such departures from the present disclosure as come within the known or customary practice in the art to which it pertains and as may be applied to the central features hereinbefore set forth, and fall within the scope of the invention or the limits of the claims appended hereto.

I claim:

1. A lottery game comprising:

a) a machine readable playslip for selecting player numbers for the game;

b) said playslip having a play area for selecting player numbers, said play area having a plurality of columns of numbers from which the player can select individual numbers;

c) said playslip further having indicia for selecting consecutive days of play;

d) a printed ticket displaying the selected player numbers in a game format having multiple rows and columns of numbers;

e) a plurality of random number generators for drawing of a plurality of lottery sponsor numbers for use in matching with selected player numbers;

f) whereby, winning of a prize occurs when a player matches a plurality of player numbers with a plurality of lottery sponsor numbers.

2. The lottery game as set forth in claim 1, wherein:

a) said play areas of said machine readable playslip having boxes defining play areas with each box forming a matrix of selectable numbers.

3. The lottery game as set forth in claim 1, wherein:

a) said printed ticket displays said selected player numbers wherein each row of said multiple rows of player numbers includes at least a first number and a second number and the first number in each row of multiple rows of numbers are aligned to form a first column of numbers and said second number in each row of player numbers is aligned to form a second column of player numbers.

4. The lottery game as set forth in claim 1, further including:

a) a plurality of drawings of lottery sponsor numbers.

5. The lottery game as set forth in claim 1, wherein:

a) winning of a prize occurs when a player matches a one of said player numbers with one of said plurality of lottery sponsor numbers in each column of a row.

6. A method of playing a lottery game, said method comprising the steps of:

a) selecting a first set of player numbers from a predetermined group of numbers identified by a lottery sponsor;

b) providing at least a first random number generator and a second random number generator;

c) drawing by the lottery sponsor of a plurality of drawn numbers to create a first set and a second set of drawn numbers, said first set having at least one number drawn from said first random number generator and said second set having at least one number drawn from said second random number generator;

d) matching of numbers of said first set of selected player numbers with at least some drawn numbers from said first and second sets of drawn numbers;

e) drawing by said lottery sponsor of subsequent first and second sets of drawn numbers for matching with said first set of player numbers.

7. The method as set forth in claim 6, wherein:

a) some of the numbers of said first set of player numbers may be duplicates and some of said numbers of said first set of drawn numbers may be duplicates of said second set of drawn numbers.

8. A lottery game comprising the steps of:

a) choosing by a player at the point of purchase an amount of a wager and a number of consecutive days of participation in the lottery game as well as a selection of player numbers for matching with a set of drawn numbers selected by a lottery sponsor;

b) obtaining by the player of a ticket at the point of purchase, said ticket identifying the amount of wager and number of consecutive days of participation as well as said selection of player numbers in a game format determined by the lottery sponsor;

c) drawing by the lottery sponsor of said set of drawn numbers wherein said set of drawn numbers is produced by consecutive drawings of a plurality of drawn numbers wherein each of said drawn numbers is produced from one of a plurality of random number generators, each said generator having an equal amount of selectable numbers;

d) matching by the player of at least some of said player numbers with at least some of said drawn numbers, wherein a prize is determined according to an amount of matched numbers and consecutive days played.

9. The method as set forth in claim 8, wherein:

a) some of the numbers of said first set of player numbers may be duplicates and some of said numbers of said first set of drawn numbers may be duplicates of said second set of drawn numbers.

* * * * *